US005452514A

United States Patent [19]

Enfaradi

[11] Patent Number: 5,452,514

[45] Date of Patent: Sep. 26, 1995

[54] FRUIT CUTTING APPARATUS

[76] Inventor: Abbas N. Enfaradi, P.O. Box 18927, Atlanta, Ga. 31126

[21] Appl. No.: 191,652

[22] Filed: Feb. 4, 1994

[51] Int. Cl.[6] ..... B26B 17/02

[52] U.S. Cl. ..... 30/272.1; 30/299; 30/253

[58] Field of Search ..... 30/272.1, 299, 30/314, 114, 246, 242, 244, 253; 606/142; 83/13

[56] References Cited

U.S. PATENT DOCUMENTS

| | | | |
|---|---|---|---|
| 1,002,242 | 9/1911 | Ehrhardt | 30/299 |
| 1,348,194 | 8/1920 | Wescott | 30/272.1 |
| 3,829,968 | 8/1974 | Houlmiere | 20/272.1 |
| 3,830,151 | 8/1974 | Gerson . | |
| 3,853,050 | 12/1974 | Schier . | |
| 3,913,226 | 10/1975 | Lovato et al. . | |
| 3,961,418 | 6/1976 | Neveu . | |
| 4,095,518 | 6/1978 | Jones . | |
| 4,394,864 | 7/1983 | Sandhaus | 606/142 |
| 4,738,195 | 4/1988 | Berube et al. . | |
| 5,141,519 | 8/1992 | Smith et al. | 30/242 |
| 5,199,350 | 4/1993 | Lin . | |

*Primary Examiner*—Richard K. Seidel
*Assistant Examiner*—Allan M. Schrock

[57] ABSTRACT

A fruit cutting apparatus comprises a handle having a hollow bore, a two-part blade assembly supported at the end of the handle and a plunger axially supported in the bore of the handle for axial sliding movement at the end of the handle opposite to that of the blade assembly. The blade assembly has sharpened peripheral edges and terminates in a sharpened tip to facilitate penetration of the blade assembly into the interior of a piece of fruit. An actuating assembly connected between the plunger and the blade assembly causes the two parts thereof to extend laterally between a first inactivated position and a second activated position. The outwardly facing peripheral edges of the blade parts are arcuately shaped so that when the blades are actuated to the second activated position, a thin circular transverse cut may be made internally of the piece of fruit after penetration of the blade assembly therein. When the piece of fruit subsequently is segmented into a plurality of separate wedge shaped pieces, each piece will have a transverse cut permitting it to be mounted on the rim of a glass or other beverage container.

6 Claims, 3 Drawing Sheets

FRUIT CUTTING APPARATUS

BACKGROUND OF THE INVENTION

1. Field of the Invention

The present invention relates generally to hand held cutting implements, and more particularly, to an actuatable dual-bladed knife for making a circular transverse cut interiorly of a piece of fruit.

2. Description of the Prior Art

It is well known to provided various apparatuses for cutting pieces of fruit into a plurality of individual, similarly shaped segments. Typical devices of this kind are disclosed in U.S. Pat. Nos. 3,830,151; 4,095,518; and 5,199,350.

Other devices are known which are adapted to peel or remove the rind or skin from a piece of fruit. Typical forms of apparatus of this type are disclosed in U.S. Pat. Nos. 3,853,050; 3,913,226; 3,961,418; and 4,738,195.

It has long been desired to provide a cutting implement which is capable of making a transverse cut inside a piece of fruit so that when the fruit is subsequently cut into plurality of segments, a transverse cut medially of the inside edge of the fruit segments already is present thus permitting the fruit segment to be mounted easily on the lip of a glass or other beverage container. Insofar as is known to applicant, such transverse cuts must be made manually in each piece with a straight knife after a fruit is segmented. Not only is the manual method a time consuming process, but because it requires repetitive handling of a sharp knife blade thereby the possibility of injuries is increased. This is especially so in restaurant or cocktail lounge facilities where a large volume of segmented fruit pieces having transverse cuts is required on a daily basis. Ideally, an effective cutting implement for making a transverse cut interiorly of a piece of fruit will have the following advantages: (1) it will be simple in construction, having relatively few parts, and thereby be low in cost; (2) it will be able to easily penetrate a piece of fruit without unduly removing fruit material so that the fruit piece may subsequently be segmented; (3) it will have a rapid actuation permitting the interior transverse cut to be made rapidly and safely; (4) it will be easily cleaned and maintained, and (5) it will be durable, yet light in weight.

A cutting implement meeting the foregoing desideratum is met by the present invention as will be made apparent from the following description thereof. Other advantages of the present invention over the prior art also will be rendered evident.

SUMMARY OF THE INVENTION

To achieve the foregoing and other advantages, the present invention, briefly described, provides a handle having a hollow bore, a two-part blade assembly supported at the end of the handle and a plunger axially supported in the bore of the handle for axial sliding movement at the end of the handle opposite to that of the blade assembly. The blade assembly has sharpened peripheral edges and terminates in a sharpened tip to facilitate penetration of the blade assembly into the interior of a piece of fruit. An actuating assembly connected between the plunger and the blade assembly causes the two parts thereof to extend laterally between a first inactivated position and a second activated position. The outwardly facing peripheral edges of the blade parts are arcuately shaped so that when the blades are actuated to the second activated position, a thin circular transverse cut may be made internally of the piece of fruit after penetration of the blade assembly therein. When the piece of fruit subsequently is segmented into a plurality of separate wedge shaped pieces, each piece will have a transverse cut permitting it to be mounted on the rim of a glass or other beverage container.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the most preferred embodiment(s) of the invention more completely, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fruit cutting apparatus containing all of the advantages of the prior art and none of the disadvantages.

It is another object of the present invention to provide a new an improved fruit cutting apparatus which may be easily and efficiently manufactured and marketed.

It is a further objective of the present invention to provide a new and improved fruit cutting apparatus that is of durable and reliable construction.

An even further object of the present invention is to provide a new and improved fruit cutting apparatus susceptible of a low cost of manufacture with regard to both materials and labor, and which accordingly is then susceptible of low prices of sale to the consuming public, thereby making such fruit cutting apparatus available to the buying public.

Still yet a further object of the present invention is to provide a new and improved fruit cutting apparatus that is portable, light in weight and easily storable when not in use.

Another object of the present invention is to provide a new and improved fruit cutting apparatus adapted to be inserted into a piece of fruit and make a transverse circular cut therein.

Still a further object of the present invention is to provide a new and improved fruit cutting apparatus having a two-part blade which latter is adapted to be inserted into a piece of fruit and actuated to make a circular shaped cut therein without effected the remainder of the piece of fruit whereby the latter may be segmented into a plurality of individual pieces after withdrawal of the blade from the piece of fruit and each segmented piece has a transverse cut in its inwardly facing edge to facilitate mounting of the segmented piece on the lip of a glass or similar beverage container.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
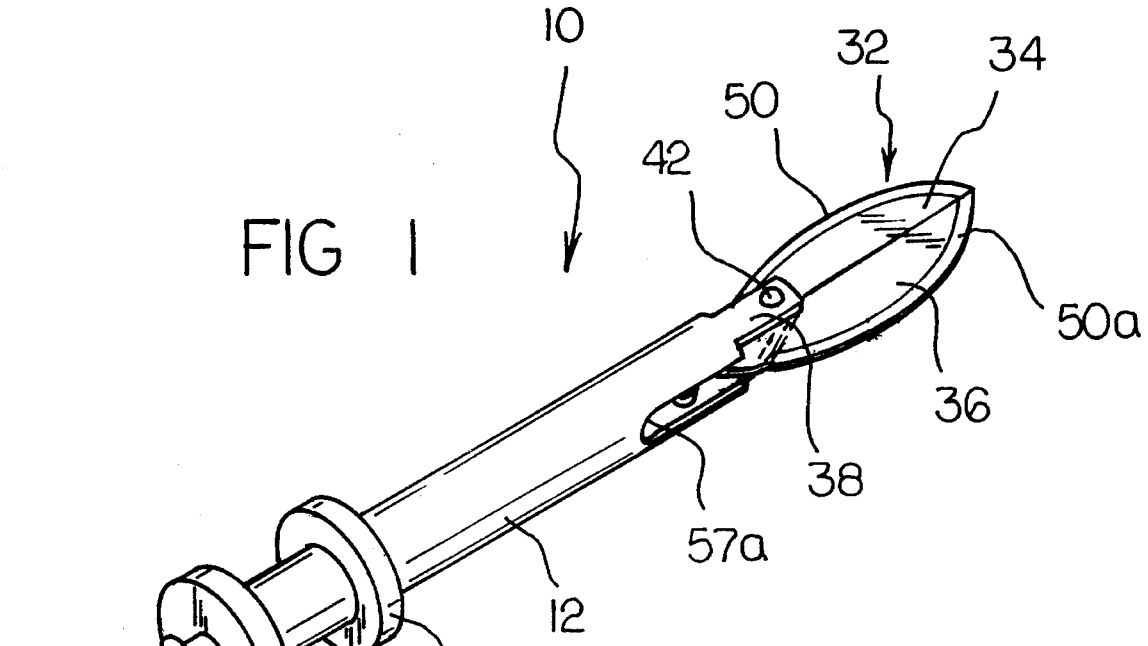
FIG. 1 is a perspective view of the fruit cutting apparatus of the invention in an inactivated condition.

With reference now to the drawings, a new and improved fruit cutting apparatus embodying the principles and concepts of the present invention will be described.

Turning initially to FIGS. 1—4, there is shown the most preferred embodiment of the fruit cutting apparatus of the present invention generally designated by reference numeral 10. In its mostly preferred form, fruit cutting apparatus 10 comprises a generally cylindrically shaped elongate hollow handle 12 having an interior bore 14 and a first proximal enlarged end 16 having a central opening 18 therein for receiving the connecting rod 18 of a bullet-nosed plunger 20 suitably adapted for slidable longitudinal movement within the bore 14. The connecting rod terminates in a disc shaped end piece 22 having a flat end face 24 for engagement preferably by the thumb of a user. The end piece 22 confronts end 16 and is similarly shaped and sized substantially as shown. Spaced axially along the longitudinal extent of the exterior of the handle is a fixed circular collar 26 which serves as a convenient gripping flange for the fingers of the user's hand when the latter's thumb engages end face 24.

Figure 2:
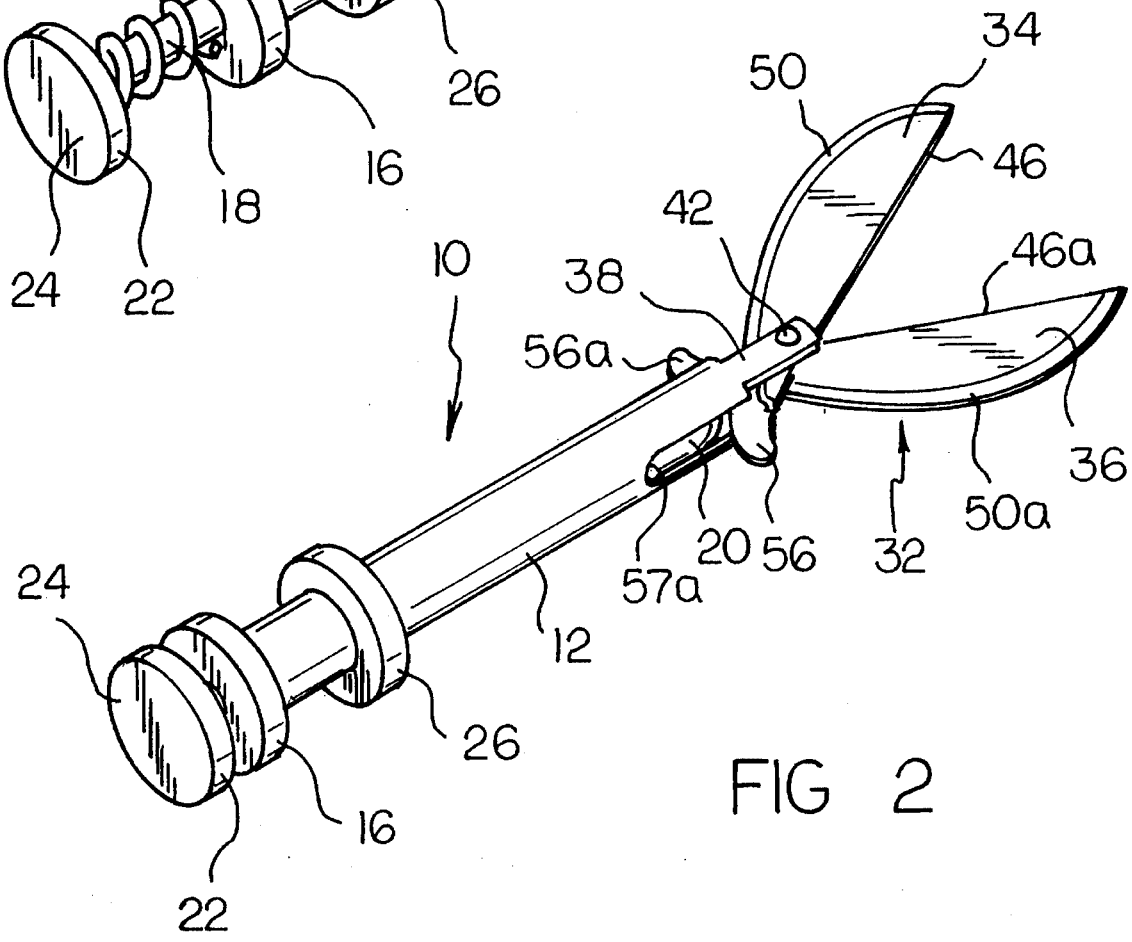
FIG. 2 is a perspective view of the fruit cutting apparatus of the invention in an activated condition.

A coiled spring member having one end engaging end 16 and an other opposed end engaging the rear side (not shown) of end piece 22 resiliently biases the connecting rod and the plunger in the inactivated normal condition of the cutting apparatus 10 as shown in FIG. 1. Spring allows the end piece 22, connecting rod 18 and plunger 20 to be longitudinally displaced to the right relative to handle 12 as viewed in FIG. 1 to thereby activate the blade assembly 22 mounted on the distal end of handle 12 as shown in FIG. 2 and as will be described in more detail below.

Figure 3:
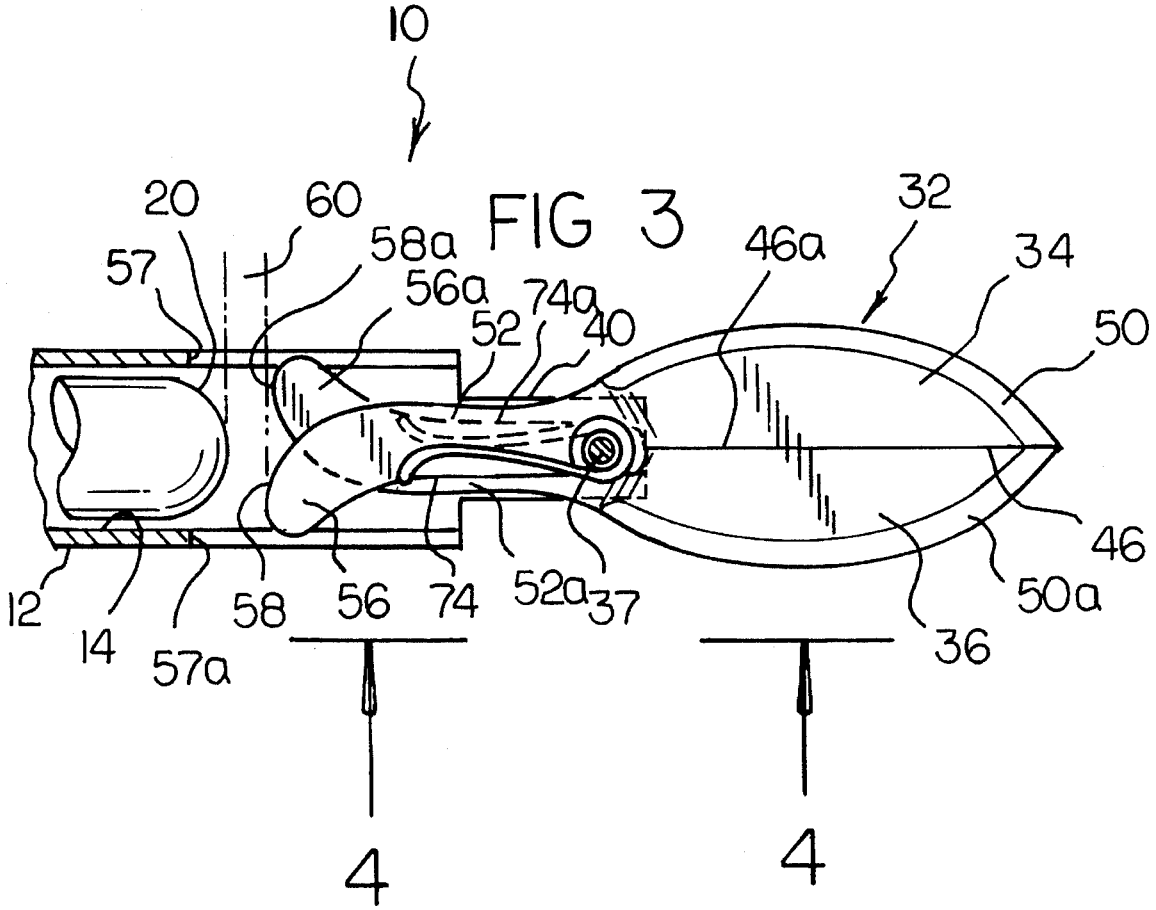
FIG. 3 is a plan view of the front portion of the fruit cutting apparatus shown partly in cross section.
Figure 4:
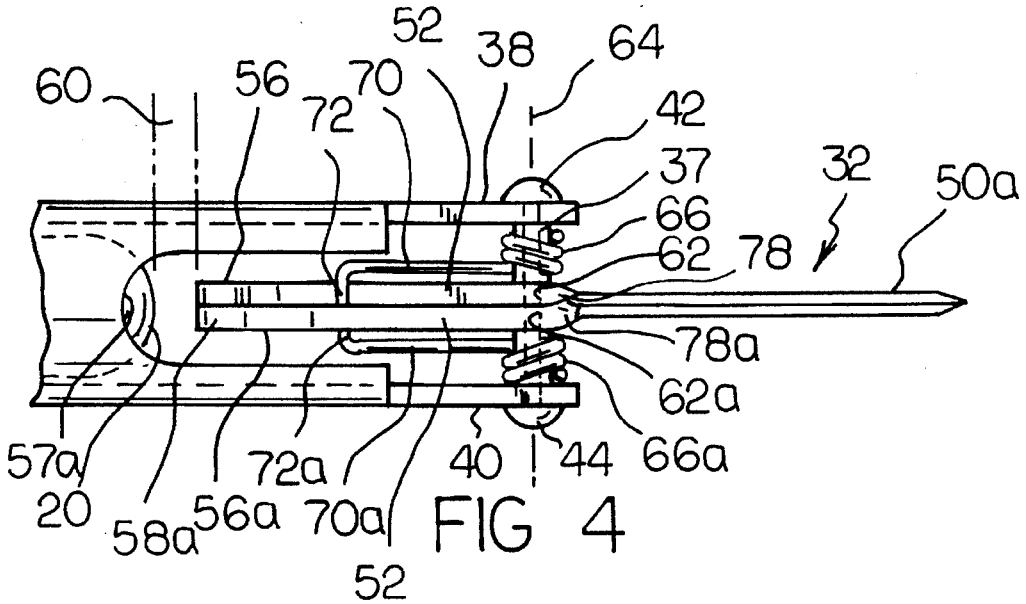
FIG. 4 is an elevation taken along line 4—4 of FIG. 3.

Paying particular attention now to FIGS. 3 and 4, blade assembly 32 comprises first and second juxtaposed blade members 34, 36 pivotally mounted on a transverse pin or axle 37 suitably captured in a pair of opposed aligned openings in bifurcated end portions 38, 40 of handle 12 by a pair of corresponding rivet heads 42, 44 substantially as depicted. Each blade member 34, 36 is generally arcuately shaped, has a flat transverse inwardly facing edge 46, **46*a*, and an outwardly facing knife blade or sharpened peripheral edge 50, 50*a***.

Integrally formed with blade member 34 is a first portion of a blade actuating assembly comprising a straight arm portion 52 extending from a point adjacent the proximal termination of arcuate knife edge 50 extending to and forming an end wing portion 56 which, in turn, defines a curved camming edge 58 adapted to be engaged by the bullet-nosed plunger 20 which normally reposes an axial distance 60 therefrom when the cutting apparatus is in the inactivated condition (FIG. 1). Similarly, there is integrally formed with blade member 36 a second portion of the blade actuating assembly comprising a second straight arm portion **52*a* adjacent the proximal termination of arcuate knife edge 50*a* extending toward and forming a second end wing portion 56*a* defining a second curved camming edge 58*a* adapted to be engaged by the bullet-nosed plunger 20 normally spaced axial distance 60 therefrom. Aligned apertures 62, 62*a* are provided in portions 52, 52*a*, respectively, through which axle 36 extends to define the pivot axis 64 of blade members 34, 36. End wing portions 56, 56*a* curve oppositely with respect to each other and are adapted to pivotally extend through opposed openings 57, 57*a* provided in the end of handle 12 adjacent to bifurcated portions 38, 40 (but orthogonally related thereto) when the bullet-nose plunger engages the curved cam surfaces 58, 58*a* and causes pivotal movement of the blade members 34, 36 about axis 64**.

A first centering coil spring 66 has one end engaging the underside of bifurcated portion 38 and another opposed end engaging the upper surface of straight portion 54. First centering spring 66 furthermore has an integral longitudinally extending slightly curved arm portion 70 which terminates at the end of spring arm portion 70 in a downwardly depending end portion 72 preferably engaged in a transversely recessed slot or groove in the side edge 74 of straight arm portion 54.

A second centering coil spring **66*a* similar to first coil centering spring 66 has one end engaging the topside of bifurcated portion 40 and another opposed end engaging the bottom surface of straight arm portion 52*a*. Second centering spring 66*a* also has an integral longitudinally extending slightly curved arm portion 70*a* which terminates at the end of straight arm portion 54*a* in a upwardly depending end portion 72*a* preferably engaged in a transversely recessed slot or groove (not shown) in the side edge 74*a* of straight arm portion 52*a***.

It will be observed in FIGS. 3 and 4 that the straight arm portions 52 and **52*a* lie superimposed one over the over, but that the corresponding integral blade portions lie in the same plane midway between the two superimposed straight arm portions with the respective inwardly facing flat edges 46, 46*a* of the blades being aligned and contacting each other. This arrangement is made possible by the angled portion 78, 78*a* joining each blade member and straight arm portion, respectively, shown to best advantage in FIG. 4. Thus, with reference to FIG. 4, downwardly angled portion 78 lies between straight arm portion 52 and wing portion 56 on the one hand and blade 34 on the other hand, whereas similarly, upwardly angled portion 78*a* lies between straight arm portion 52***a* and wing portion 56*a* on the one hand and blade 36 on the other hand.

Figure 5:
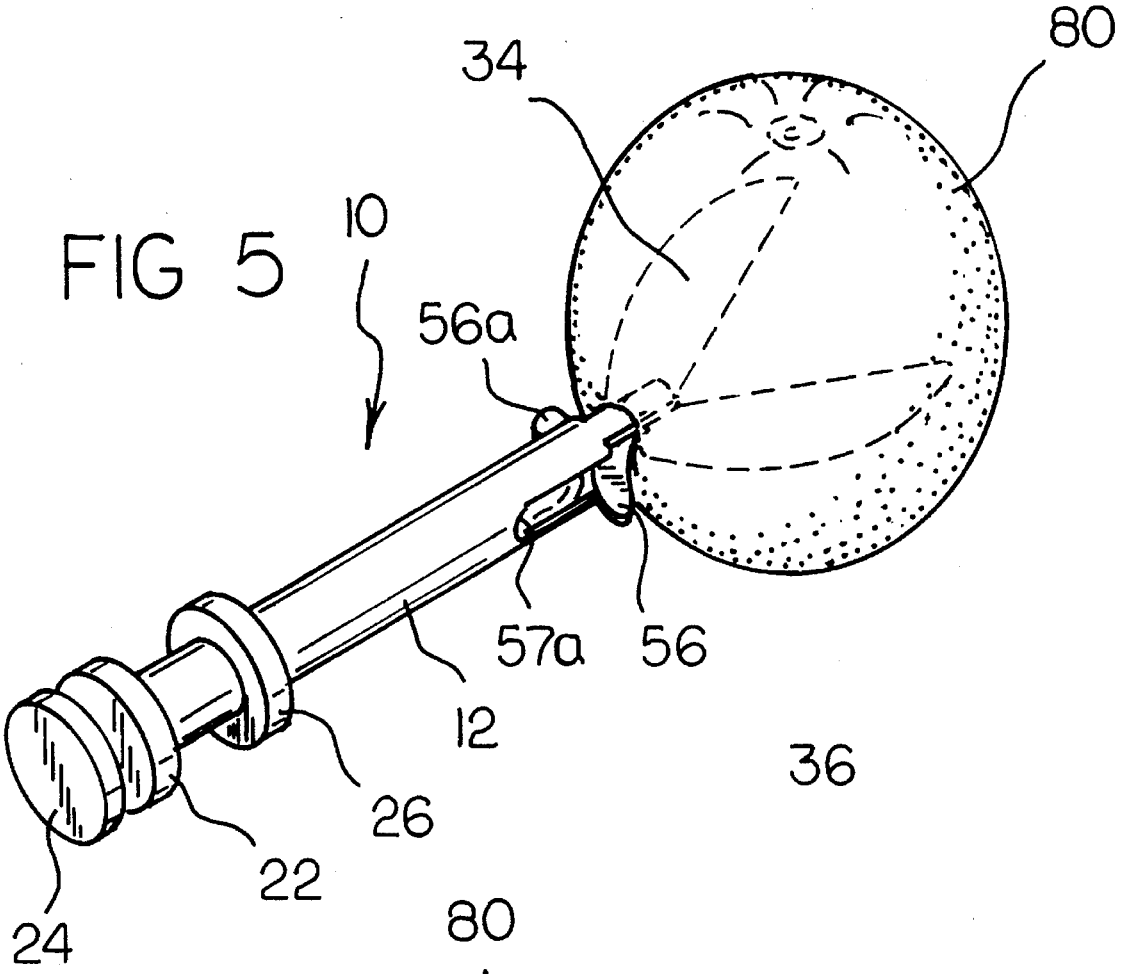
FIG. 5 is a perspective view showing the fruit cutting apparatus inserted into a piece of fruit and being in the activated condition.

The first and second centering coil springs 66 and 66*a* have two functions, namely to (1) maintain the blades centered on axle 37; and (2) resiliently bias blade members 34, 36 in their closed or inactivated condition as shown in FIGS. 1, 3 and 4. Thus, when bullet-nose plunger 20 is advanced to the right as viewed in FIGS. 3 and 4, by compressing end piece 22 toward handle end 16, the resilient biasing force of the centering springs is overcome and cammimg surfaces 58, 58*a* of wings 56, 56*a* are engaged by bullet-nosed plunger 20 and caused to pivot laterally away from each other passing through openings 57, 57*a*. In turn, by this action, arcuate shaped blades 34, 36 are caused to swing away from each other in a scissors-like manner making a circular transverse cut through the fruit substance being engaged thereby as substantially depicted in FIGS. 2 and 5.

Figure 6:
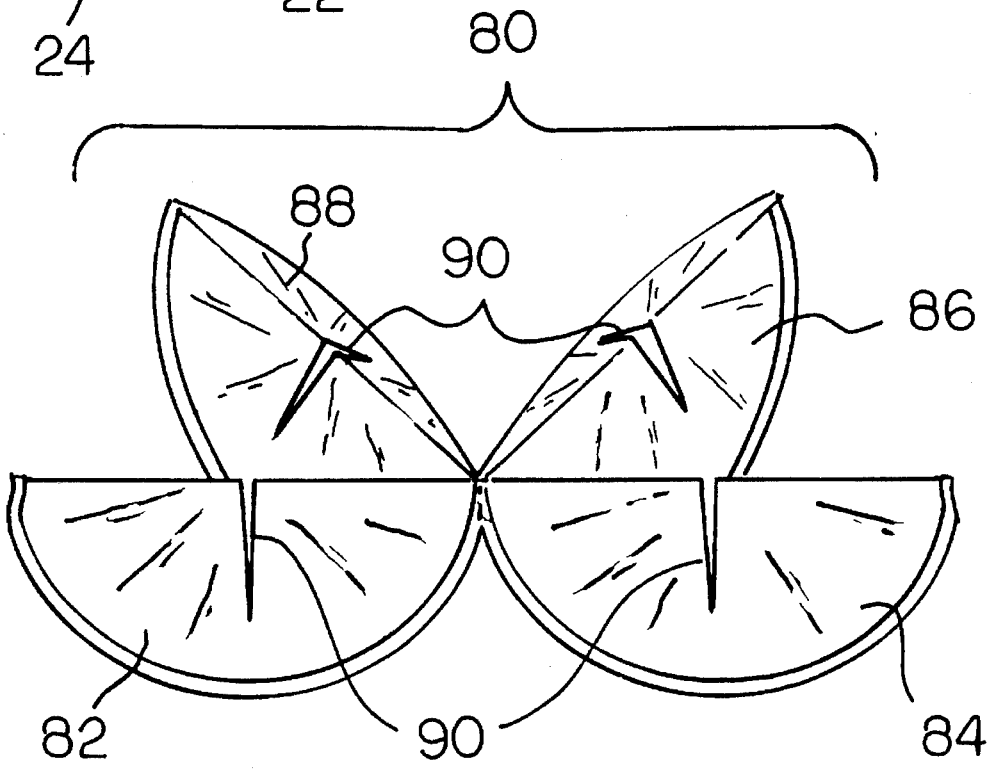
FIG. 6 is a perspective view of segments of a piece of fruit showing the transverse cut made by the fruit cutting apparatus of the present invention.

In accordance with the present invention, the operation of handle 12 and plunger 14, etc. is quite similar to that of a hypodermic syringe. Accordingly, after grasping handle 12 by the hand and inserting the distal tip of the cutting apparatus into a piece of fruit 80 (e.g. lemon or orange) with the tip being inserted parallel to the equatorial plane of the fruit as substantially shown in FIG. 5, the collar may be grasped by two fingers of the user's hand and the thumb of that hand used to press the plunger toward the fruit piece thereby effecting a relatively thin circular cut inside the piece of fruit. After the cutting apparatus has been withdrawn, the fruit piece may then be sliced in a conventional manner to produce individual wedge shaped segments 82, 84, 86, and 88 as shown in FIG. 6 with each piece already having the desired transverse cut 90 in the inside edge thereof produced by the aforementioned action of the cutting apparatus 10 of the present invention prior to the piece of fruit being segmented.

It is apparent from the above that the present invention accomplishes all of the objectives set forth by providing a new and improved fruit cutting apparatus having a two-part scissors-like blade which latter is adapted to be inserted into a piece of fruit and actuated to make a circular shaped cut therein without effecting the remainder of the piece of fruit whereby the piece of fruit then may be segmented into a plurality of individual pieces after withdrawal of the blade and each segmented piece has a transverse cut in its inwardly facing edge which transverse cut facilitates mounting of the segmented piece onto the lip of glass or similar beverage container, and wherein the foregoing invention includes the following advantages: (1) it is simple in construction, having relatively few parts, and thereby low in cost; (2) it is able to easily penetrate a piece of fruit without unduly removing fruit material so that the fruit piece may subsequently be segmented; (3) it has a rapid actuation permitting the internal cut to be made rapidly; (4) it may easily cleaned and maintained, and (5) it is durable, yet light in weight.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use. For example, the axially movable plunger 20 may be actuated by a pliar-type second pivotal handle attached to handle 12 in lieu of the syringe type actuator shown.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the Abstract provided at the beginning of this specification is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A cutting apparatus comprising:

an elongate hollow handle having an interior bore and a central axis, a first proximal end having a central opening therein, the handle being shaped so as to define a bifurcated second end including spaced furcations;

a bullet-nosed plunger slidably positioned within the bore and to slide along said axis;

a transverse pin extending between the furcations of the bifurcated end of the handle;

a first blade member pivotally mounted on the transverse pin, the first blade member including a first flat transverse inwardly facing edge and an outwardly facing sharpened first peripheral edge, the first bade member further including a first straight arm portion terminating in a first curved camming edge adapted to be engaged by the bullet-nosed plunger;

a second blade member pivotally mounted on the transverse pin, the second blade member including a second flat transverse inwardly facing edge and an outwardly facing sharpened second peripheral edge, the second blade member further including a second straight arm portion terminating in a second curved camming edge adapted to be engaged by the bullet-nosed plunger, the blade members being positionable such that the flat transverse inwardly facing edges coextensively abut one another;

wherein the bullet-nosed plunger slidably advances through the handle and into engagement with the camming edges of the blade members to pivot the first camming edge about the pin so as to extend relative to the handle in a first direction and to pivot the second camming edge about the pin so as to extend relative to the handle in a second direction opposite to the first direction, wherein the first blade member pivots about the pin so as to extend relative to the handle in the second direction and the second blade member pivots about the pin so as to extend relative to the handle in the first direction.

2. The cutting apparatus of claim 1, and further comprising centering spring means for positioning the flat transverse inwardly facing edges into a normally abutting relationship.

3. The cutting apparatus of claim 2 wherein the centering spring means comprises a first centering coil spring having a first end engaging a furcation of the handle and a second end engaging the first straight arm portion; and a first centering coil spring having a second end engaging another furcation of the handle and a second end engaging the second straight arm portion.

4. The cutting apparatus of claim 3, wherein the plunger is shaped so as to define a disc shaped end piece positioned exterior of the handle; and further comprising a coiled spring member interposed between the first proximal end and of the handle and the disc shaped end piece so as to bias the plunger from the camming surfaces.

5. The cutting apparatus of claim 3, wherein the outwardly facing sharpened first peripheral edge and the first blade member straight arm portion terminating in a first curved camming edge is joined by a first intermediate section, and wherein the outwardly facing sharpened second peripheral edge and the second blade member straight arm portion terminating in a second curved camming edge is joined by a second intermediate section, wherein said first and second intermediate sections are juxtaposed relative to each other and extend angularly with respect to each other such that said first and second peripheral edges lie in a common plane and the first and second straight arm portions overlap each other and lie in parallel planes spaced above and below said common plane.

6. The cutting apparatus of claim 2 wherein said outwardly facing sharpened first and second peripheral edges are convexly shaped to form an elliptically shaped substantially flat cutting head extending axially from said handle bifurcated end and terminating in a pointed distal end, the minor transverse dimension of said elliptically shaped head extending orthogonally with respect to said bore axis and the axis of said pivot pin.

* * * * *